US007243740B2

(12) United States Patent
Frith

(10) Patent No.: US 7,243,740 B2
(45) Date of Patent: Jul. 17, 2007

(54) FILTER ASSEMBLY HAVING A BYPASS PASSAGEWAY AND METHOD

(75) Inventor: Terrence G. Frith, Lafayette, LA (US)

(73) Assignee: PathFinder Energy Services, Inc., Houston, TX (US)

( * ) Notice: Subject to any disclaimer, the term of this patent is extended or adjusted under 35 U.S.C. 154(b) by 274 days.

(21) Appl. No.: 10/984,466

(22) Filed: Nov. 9, 2004

(65) Prior Publication Data

US 2005/0121233 A1 Jun. 9, 2005

Related U.S. Application Data

(60) Provisional application No. 60/527,614, filed on Dec. 5, 2003.

(51) Int. Cl.
*E21B 4/02* (2006.01)

(52) U.S. Cl. ..... 175/107; 166/205; 210/132; 210/430

(58) Field of Classification Search ..... 175/107; 166/205; 137/599.14, 601.2; 210/129, 130, 210/132, 335, 340, 430, 449, 498
See application file for complete search history.

(56) References Cited

U.S. PATENT DOCUMENTS 3,283,902 A 11/1966 Farris et al.
4,495,073 A 1/1985 Beimgraben
5,160,037 A 11/1992 LeCour
5,762,137 A 6/1998 Ross et al.
5,857,521 A 1/1999 Ross et al.
5,885,447 A 3/1999 Theisen et al.
6,155,342 A 12/2000 Oneal et al.
6,296,055 B1 10/2001 Taylor
6,571,869 B1 * 6/2003 Pluchek et al. ..... 166/205
6,598,685 B1 7/2003 Mashburn
2002/0011435 A1 1/2002 Koltunov

FOREIGN PATENT DOCUMENTS

WO WO 02/62447 A1 1/2002

* cited by examiner

*Primary Examiner*—Lanna Mai
*Assistant Examiner*—Matthew J. Smith

(57) ABSTRACT

A filter assembly including a primary flow passageway having at least one filter deployed therein and a secondary flow passageway having a bypass filter deployed therein is provided. The filter assembly further includes a bypass valve assembly configured to selectively open and close the secondary flow passageway when a fluid pressure is respectively above and below an adjustable, predetermined threshold value. Exemplary embodiments of this invention may be coupled to a drill string and advantageously utilized to filter drilling fluid downhole. Such embodiments tend to advantageously improve the filtering efficiency and safety of drilling operations.

44 Claims, 3 Drawing Sheets

FILTER ASSEMBLY HAVING A BYPASS PASSAGEWAY AND METHOD

RELATED APPLICATIONS

This application claims the benefit of U.S. Provisional Application Ser. No. 60/527,614 entitled *Drilling Fluid Filter Assembly Having a Bypass Passageway*, filed Dec. 5, 2003.

FIELD OF THE INVENTION

The present invention relates generally to filtering devices. More particularly, this invention relates to a downhole filtering tool including a filtered, pressure activated, bypass flow passageway.

BACKGROUND OF THE INVENTION

The use of drilling fluids for the drilling of subterranean boreholes is well known. The drilling fluid serves numerous purposes, including, for example, suppression of formation pressure, lubrication of the drill string, flushing drill cuttings away from the drill bit, cooling of the bottom hole assembly, driving turbines that provide power for various downhole tools, and powering downhole progressive cavity motors. In use drilling fluids are typically pumped down through the tubular drill string to the drill bit and circulate back to the surface in the annular region between the drill string and the borehole wall. The circulating drilling fluid typically carries drill cuttings, metal shavings, and other debris to the surface. Large particles, having a size that may damage sensitive downhole tools, such as various measurement while drilling (MWD) or logging while drilling (LWD) tools, or plug drill bit jets are desirably removed from the drilling fluid before recycling back into the borehole.

Various surface filtering techniques are well known in the industry for removing drill cuttings and other debris from the drilling fluid. For example, shaker tables are commonly used to screen out relatively large particles (e.g., having a diameter greater than ⅛ inch). Centrifugal tools, such as desanders and desilters are also commonly used to remove abrasive solids prior to recycling the drilling fluid back into the borehole. However, it is not uncommon for such surface filtering techniques to fail, resulting in large drill cuttings and debris being pumped downhole. Additionally, various "foreign objects", such as tools, rags, gravel, chunks of plastic from thread protectors, and the like are sometimes introduced into the drilling fluid through human error and inadvertently pumped downhole.

As a redundant measure, pipe screens are commonly used on the topmost section of drill string with the intention of preventing large particles and debris from being pumped downhole. While such pipe screens have been successfully utilized and are commercially available, they are nevertheless prone to failure in that operator intervention is required to remove, clean, and reposition the screen each time a new length of drill string is added. Furthermore, damaging scale and/or cement particles often originate from locations within the drill string. Scale particulate may result, for example, from corrosion of the drill string components or various mineral deposits, while cement particles are sometimes deposited on the interior of the drill string during cementing operations. Such particles are sometimes freed during drilling operations and are a known source of blockage or damage to downhole tools.

In an attempt to overcome such difficulties, retrievable downhole filtering tools are known, for example, those disclosed by Beimgraben in U.S. Pat. No. 4,495,073, Taylor in U.S. Pat. No. 6,296,055, and Mashburn in U.S. Pat. No. 6,598,685. Such retrievable filtering tools are intended to be periodically removed from the drill string and cleaned (e.g., when the pressure at the mud pump reaches some predetermined threshold). While such prior art filtering tools may, in certain applications, remove damaging particles from the drilling fluid, their retrieval from the drill string is often problematic. For example, in certain drilling applications, it may be advantageous for various sections of the drill string to include a reduced inner diameter. However, such a reduced inner diameter may render it impossible to retrieve the filtering tools. Furthermore, in deep well applications (e.g., at measured depths greater than 10,000 feet), it is sometimes difficult to generate the impact required to dislodge the filtering tool from the drill string (e.g., to shear one or more shear pins). In such instances it is often necessary to remove at least a portion of the drill string from the borehole (at significant expense and time loss) in order to retrieve the filtering tool. Moreover, the act of retrieving such retrievable filtering tools has been known to cause debris to be freed or dumped in the drill string.

Therefore, there exists a need for an improved downhole filtering tool for filtering a drilling fluid. In particular there exists a need for a downhole filtering tool that does not generally require retrieval from the drill string.

SUMMARY OF THE INVENTION

The present invention addresses one or more of the above-described drawbacks of prior art drilling fluid filtering apparatuses. Exemplary aspects of this invention include a filtering tool configured for deployment in a drill string. The filtering tool typically includes one or more filters configured for capturing large particles, for example, greater than about ⅜ inch, from the drilling fluid. The one or more filters may advantageously be fabricated from a hard, wear resistant material, and are configured to hold the large particles until they erode to a sufficiently small size to pass through the filter(s). The filtering tool further includes a filtered bypass flow passageway (also referred to as a secondary flow passageway) in the event that the one or more filters become substantially full of debris. A bypass valve assembly is configured to open, thereby allowing drilling fluid to flow through the bypass flow passageway, when the pressure of the drilling fluid exceeds a predetermined threshold.

Exemplary embodiments of the present invention advantageously provide several technical advantages. Embodiments of the filtering tool of this invention advantageously provide a filtered secondary flow passageway that may be opened at a predetermined threshold pressure. Further, the threshold pressure may be adjusted at the surface (e.g., by a drilling operator) to meet the requirements of various drilling applications. The use of a filtering tool having a secondary flow passageway may also advantageously improve the safety of drilling operations. In the event that the filter(s) become substantially full of debris and the pressure of the drilling fluid increases, circulation of the drilling fluid may be maintained and the well kept under control, via diverting a portion of the flow through the secondary flow passageway. In many instances, drilling operations may continue.

Moreover, exemplary embodiments of this invention may also be configured to be "self-cleaning" in that the filter(s) may trap and hold large particles until they erode to a smaller size, potentially obviating the need to use retrievable filters (as with the above described prior art tools).

In one aspect the present invention includes a filtering assembly. The filtering assembly includes a housing having a through bore that provides a primary flow passageway through the housing. A bypass flow tube deployed in the through bore provides a secondary flow passageway through the housing. At least one primary filter is deployed in the primary flow passageway, and a bypass filter is disposed to filter fluid flow through the secondary flow passageway. The filtering assembly further includes a bypass valve assembly deployed in the housing and disposed to selectively open the secondary flow passageway when a fluid pressure reaches a predetermined threshold pressure. In certain exemplary embodiments of this invention, first and second primary filters may be deployed about the bypass flow tube. Moreover, in some exemplary embodiments, the bypass filter may be coupled to an upstream end of the bypass flow tube, while the bypass valve assembly may be located proximate to a downstream end of the bypass flow tube.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
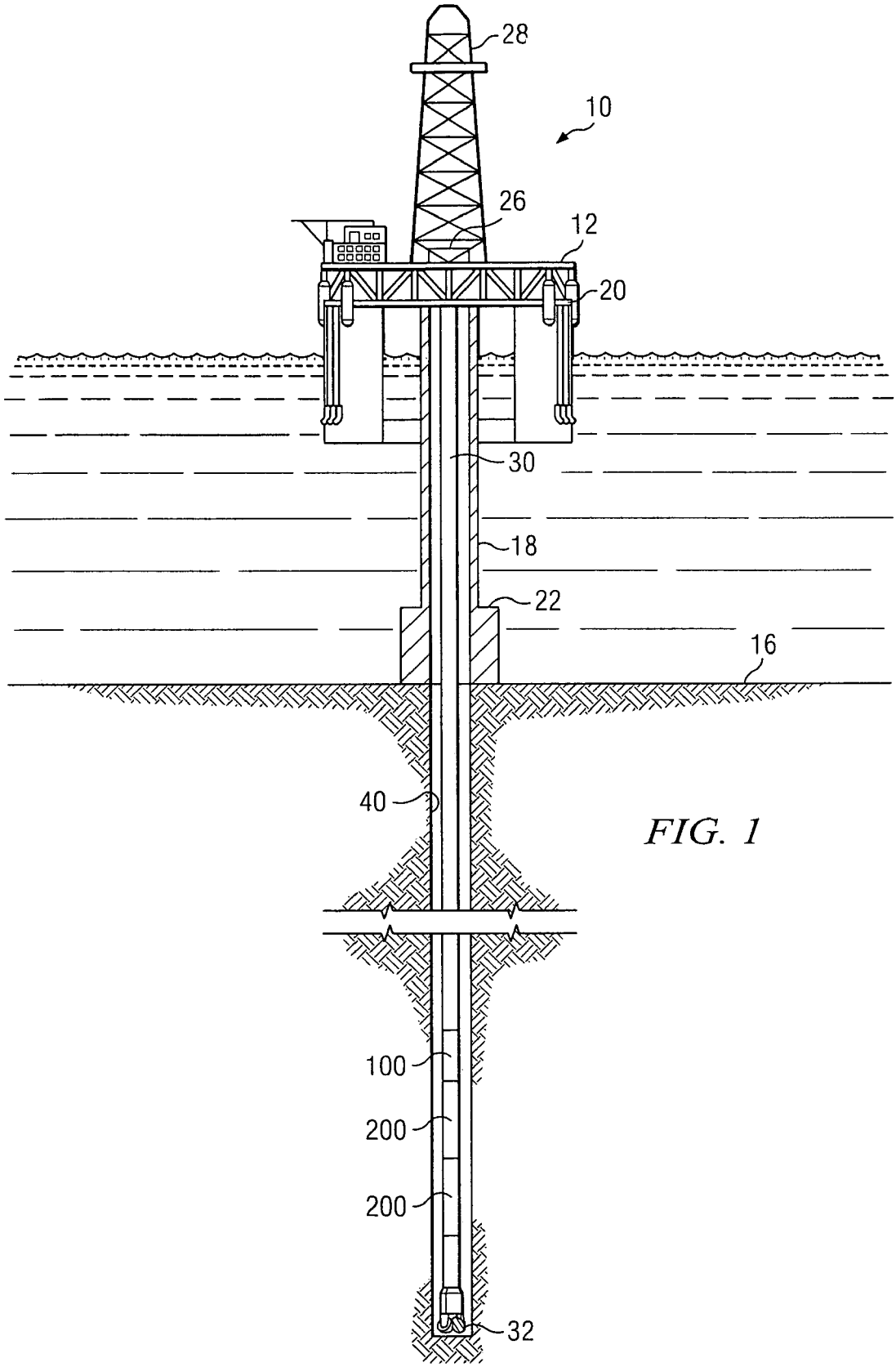
FIG. 1 is a schematic representation of an offshore oil and/or gas drilling platform utilizing an exemplary embodiment of the present invention.

FIG. 1 schematically illustrates one exemplary embodiment of a downhole filtering sub 100 according to this invention in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and filtering sub 100. In the embodiment shown, downhole filtering sub 100 is deployed in the drill string 30 above one or more downhole measurement tools 200 (e.g., MWD or LWD tools). It will be appreciated that filtering sub 100 may be deployed in substantially any location in the drill string 30. However, in certain applications the filtering sub 100 may be advantageously deployed near the bottom of the drill string 30, but above sensitive measurement tools, such as measurement tools 200.

It will be understood by those of ordinary skill in the art that the deployment illustrated on FIG. 1 is merely exemplary for purposes of describing the invention set forth herein. It will be further understood by those of ordinary skill in the art that the filtering sub 100 of the present invention is not limited to use with a semisubmersible platform 12 as illustrated in FIG. 1. Downhole filtering sub 100 is equally well suited for use with any kind of subterranean drilling operation, either offshore or onshore.

It will be further understood that the present invention is also not limited to subterranean drilling applications. Embodiments of the invention include a filter assembly that has a filtered, pressure activated, bypass flow passageway.

Referring to FIGS. 2 through 5, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 2 through 5 may be described herein with respect to that reference numeral shown on other views.

Figure 2:
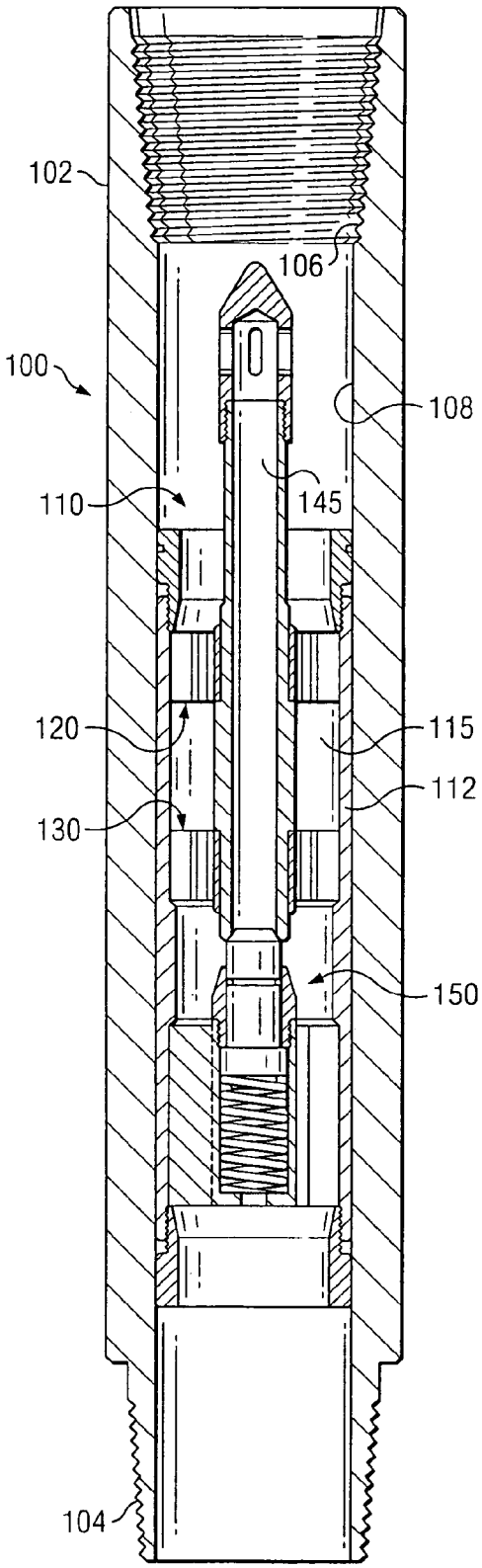
FIG. 2 depicts, in cross section, a drilling sub in which embodiments of this invention may be deployed.

With reference now to FIG. 2, an exemplary filter sub 100 according to this invention is shown in longitudinal cross section. Filter sub 100 includes a tubular tool body 102 having threaded ends 104 and 106 (commonly referred to as a box 106 and pin 104). The tool body 102 is typically sized and shaped for coupling to a conventional drill string and may be fabricated from substantially any suitable material (e.g., a high strength stainless steel). The tool body includes a center bore 108 that provides a suitable passageway for the flow of drilling fluid. In the embodiment shown, filtering sub 100 includes an internal filtering module 110 having one or more filters 120, 130 deployed in a wear sleeve 112. While the embodiment shown in FIG. 2 includes upper and lower filters 120, 130, it will be appreciated that filter sub 100 may include substantially any number of filters. Terms used in this disclosure such as "upper" and "lower" are intended merely to show relative positional relationships of various components in the described exemplary embodiments and are not limiting of the invention in any way. As described in more detail below, filtering module 110 includes primary 115 and secondary 145 flow passageways. A bypass valve assembly 150 is disposed to control the flow of drilling fluid through the secondary flow passageway 145.

Figure 3:
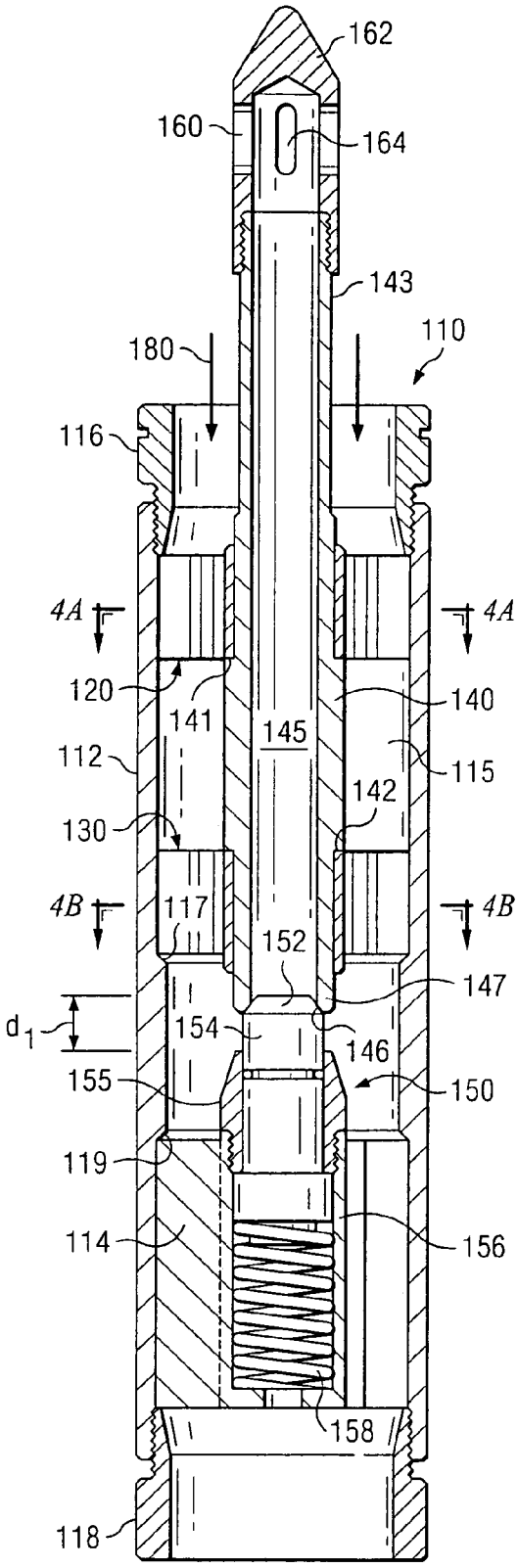
FIG. 3 depicts, in cross section, an exemplary filtering tool embodiment of this invention.

Turning now to FIG. 3, exemplary embodiments of an internal filtering module 110 according to this invention are described in more detail. As described above, the embodiment shown includes upper and lower filters 120, 130 deployed in a substantially annular primary flow passageway 115. Exemplary internal filtering module 110 further includes a bypass flow tube 140 deployed coaxially with the wear sleeve 112 and the upper and lower filters 120, 130. The bypass flow tube 140 provides a secondary flow passageway 145 (also referred to as a bypass flow passageway) and is positioned such that an upper end 143 thereof is disposed upstream of the upper filter 120 and a lower end 147 thereof is positioned downstream of the lower filter 130.

With continued reference to FIG. 3, the upper and lower filters 120, 130 may, for example, be slidably received about bypass flow tube 140. In the exemplary embodiment shown, upper filter 120 is received on the upper end 143 of the bypass flow tube 140 and abuts a first shoulder portion 141 thereof. The lower filter 130 is received on the lower end 147 of the bypass flow tube 140 and abuts a second shoulder portion 142 thereof. Screen cap 116 is threadably received in wear sleeve 112 and holds upper filter 120 securely against shoulder portion 141. Lower filter 130 is held securely in place between shoulder portion 142 and a shoulder portion 117 of wear sleeve 112.

Figure 4A:
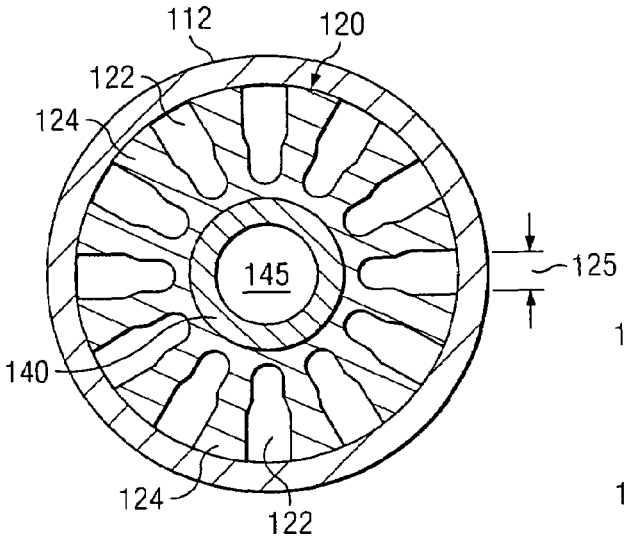
FIG. 4A is a cross sectional view as shown on section 4A-4A of FIG. 3.
Figure 4B:
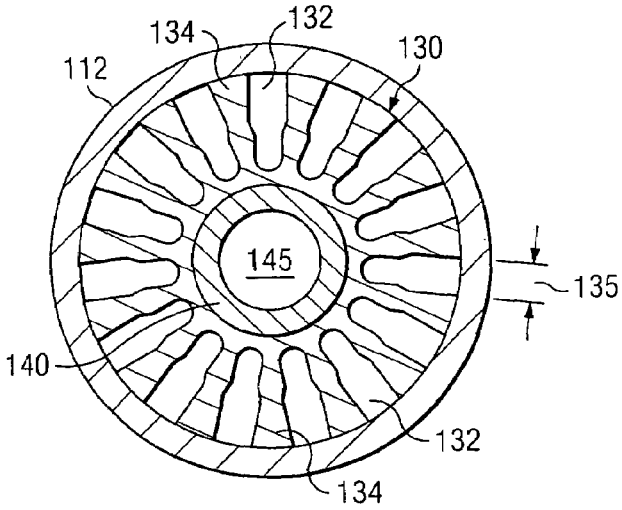
FIG. 4B is a cross sectional view as shown on section 4B-4B of FIG. 3.

Turning now to FIGS. 4A and 4B, exemplary embodiments of upper and lower filters 120, 130 are described in more detail. In the embodiments shown, upper and lower filters 120, 130 include substantially disk shaped screen portions 124, 134, each having a plurality of radial slots 122, 132 formed therein. While screen portions including perforations of substantially any shape (e.g., holes, slots, and the like) may be utilized, the use of radial slots 122, 132 may be advantageous in that filtered debris are typically less likely to fully block the flow path through the filter 120, 130. In the exemplary embodiment shown, the diameter 125 of the radial slots 122 in the upper filter 120 is greater than the diameter 135 of the radial slots 124 in the lower filter 130, however, the invention is not limited in this regard. It will be appreciated that filters having substantially any slot size may be utilized. For example, in various exemplary downhole embodiments, diameter 125 may advantageously be in the range of from about ⅜ to about ⅝ inch, while diameter 135 may advantageously be in the range of from about ¼ to about ½ inch. It will likewise be appreciated that filters 120, 130 may include substantially any slot pattern.

Filters 120 and 130 may be advantageously fabricated from a highly wear resistant material, such as a high strength stainless steel, to minimize erosion thereof in the high velocity, abrasive drilling fluid. Preferred embodiments include Rockwell C hardness values of greater than about 55. In one embodiment, screens 124 and 134 are fabricated from a D2 tool steel (a high strength, nonmagnetic, alloy steel) available from Diehl Steel in Dallas, Tex. Such highly wear resistant materials may advantageously withstand drilling fluid velocities of up to about 80 feet per second. It will be appreciated that other components, such as the bypass flow tube 140, bypass valve stem 154, bypass filter 160, and wear sleeve 112 may be advantageously fabricated from a highly wear resistant material, such as a D2 tool steel, to minimize erosion thereof.

Figure 5:
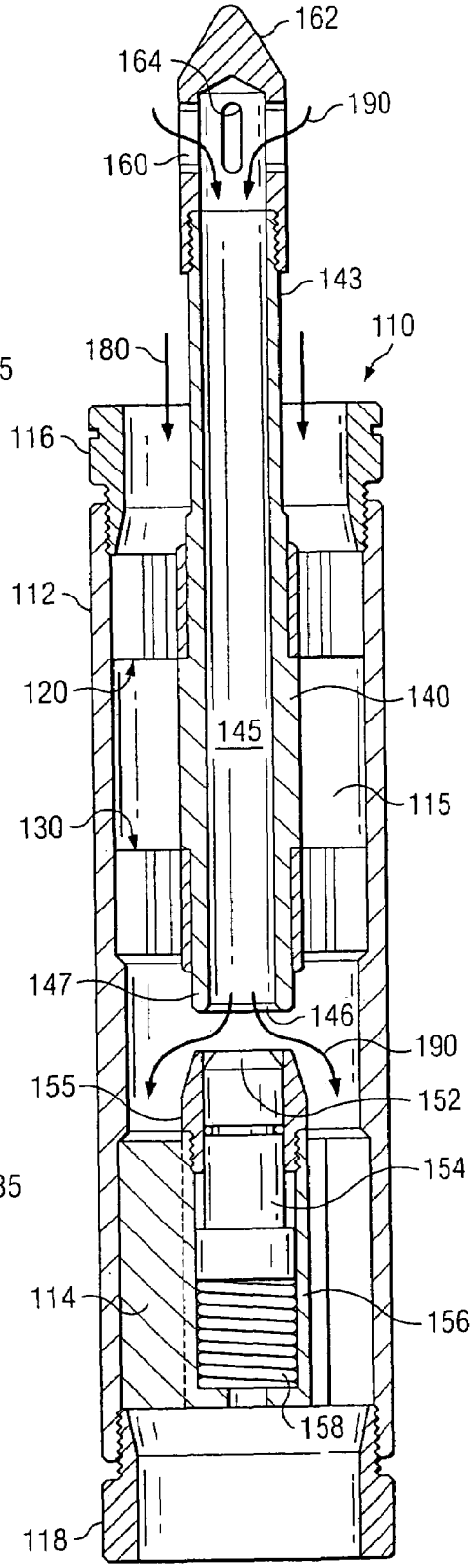
FIG. 5 depicts, in cross section, the exemplary filtering tool of FIG. 3 in a compressed configuration.

With reference again to FIG. 3, internal filtering module 110 further includes a bypass valve assembly 150 deployed therein. Bypass valve assembly 150 includes a valve stem 154 deployed (e.g., slidably received) in a bypass valve housing 156. The valve stem 154 is typically secured in the bypass valve housing 156 via a retainer nut 155. Valve stem 154 is further disposed to slide longitudinally in housing 156 such that compression of pressure setting spring 158 permits a range of longitudinal motion $d_1$. Comparison of FIGS. 3 and 5 shows valve stem 154 in opposing end positions within sliding range $d_1$. In the first position (as shown in FIG. 3), a tapered end 152 of valve stem 154 is biased into contact with a valve seat 146 on the lower end 147 of the bypass flow tube 140 via pressure setting spring 158, thereby effectively closing the secondary flow passageway. In the fully displaced position (shown in FIG. 5), pressure setting spring 158 is substantially fully compressed, thereby opening the secondary flow passageway.

Exemplary embodiments of pressure setting spring 158 may be fabricated from substantially any suitable material such as an ELGILOY® spring steel available from Elgiloy, Incorporated, Elgin, Ill. In one exemplary embodiment, pressure setting spring 158 may advantageously be rated in the range of from about 100 to about 200 pounds per compressed inch (e.g., a nominal 150 pounds per compressed inch). In such an embodiment, spring 158 may be pre-compressed, for example, about one inch to exert about 150 pounds of force when holding tapered end 152 against valve seat 146. The application of such a force on the valve stem in the rest position tends to prevent the flow of drilling fluid through the bypass flow passageway 145 under normal operating conditions (as described in more detail below). Moreover, the pressure exerted by spring 158 on valve stem 154 advantageously prevents the bypass valve assembly 150 from inadvertently opening due to mechanical forces experienced downhole, such as impact and shock.

It will be appreciated that the magnitude of the force holding the tapered end 152 of valve stem 154 against valve seat 146 may be readily adjusted at a drilling site. For example, spring 158 may be replaced with a spring member having a different spring constant (e.g., increasing the spring constant which increases the force) or a spring having another longitudinal dimension (e.g., increasing the length of the spring which increases the amount of pre-compression and thus the force). Alternatively, spacers (e.g., conventional washers) may be inserted (or removed from) between the spring 158 and the base of the bypass valve housing 156, effectively changing the amount of spring pre-compression.

In the exemplary embodiment shown, bypass valve housing 156 is fitted with a plurality of stabilizer fins 114 that extend radially outward and into contact with an inner surface of wear sleeve 112. The stabilizer fins 114 are intended to stabilize the bypass valve assembly 150 coaxially in the wear sleeve 112. In the exemplary embodiment shown, the bypass valve assembly 150 is slidably received in wear sleeve 112. As the bypass valve assembly 150 is received into the wear sleeve 112, the tapered end 152 of the valve stem 154 contacts the valve seat 146. The bypass valve assembly continues to be received into the wear sleeve 112, partially compressing spring 158 and increasing the force holding valve stem 154 against the valve seat 146, until stabilizer fins 114 contact shoulder portion 119 of wear sleeve 112. A screen cap 118 is threadably received in wear sleeve 112 and holds the stabilizer fins 114 securely against shoulder portion 119.

With continued reference to FIG. 3, internal filtering module 110 further includes a bypass filter housing 162, having a bypass filter 160, coupled (e.g., threadably coupled) to the upper end 143 of the bypass flow tube 140. It will be appreciated that bypass filter 160 may be integral with or coupled to bypass filter housing 162. Exemplary embodiments of the bypass filter 160 include a plurality of longitudinal slots 164. Longitudinal slots 164 may advantageously reduce the tendency of the bypass filter 160 to become plugged with debris as the filtered particles are typically swept past the bypass filter 160 to the upper filter 120 by the flow of the drilling fluid.

In operation, filtering sub 100 (FIG. 2) is coupled to a drill string (e.g., as shown in FIG. 1). As drilling fluid is pumped down through the drill string, it flows through the primary flow passageway 115 as shown at 180 on FIG. 3. As drill cuttings and/or various other debris are trapped in filters 120 and/or 130 the pressure of the drilling fluid increases, thereby increasing its local velocity. In general, debris continues to accumulate until the local fluid velocity becomes great enough (e.g., about 50 feet per second) to erode the debris. Such erosion of the debris reduces its size until it passes through the filters 120, 130. In the embodiment shown, in which upper and lower filters 120, 130 are employed, debris may be trapped at the upper filter 120 until it erodes sufficiently to pass there through. Such debris may then be trapped at the lower filter 130 until it erodes further and passes there through.

As the pressure of the drilling fluid increases, the pressure in the secondary flow passageway 145 (in bypass flow tube 140) also increases, thereby increasing the force of the drilling fluid against the bypass valve stem 154. In the event that the pressure increases above a predetermined threshold, the force of the drilling fluid begins to overcome the force applied by the pressure setting spring 158. As such, the bypass valve stem 154 is displaced longitudinally from its rest position, thereby allowing drilling fluid to flow through the secondary flow passageway 145 as shown at 190 on FIG. 5. As the pressure of the drilling fluid increases further, the bypass valve stem 154 is further displaced from its rest position towards a fully displaced position at which spring 158 is substantially fully compressed (as shown in FIG. 5).

As described above, the use of a filtered, secondary flow passageway often enables drilling to continue even after the upper and lower filters 120, 130 are substantially plugged with debris. Bypass filter 160 typically prevents debris from passing through the secondary flow passageway. Further, as described above, bypass filter arrangements having longitudinal slots 164 (as shown on FIGS. 3 and 5) tend to advantageously prevent clogging as debris are often swept past the bypass filter 160 to upper filter 120.

After the secondary flow passageway 145 is opened (as described above), a portion of the drilling fluid typically continues to flow through the primary fluid passageway. Such flow through the primary flow passageway, with locally high velocities owing to the high pressure, typically continues to erode the debris lodged in the upper and lower filters 120, 130. It is often the case that such continued erosion enables the debris to eventually pass through the upper and lower filters 120, 130 (as described above). In such cases the pressure of the drilling fluid decreases as the debris passes through the upper and lower filters 120, 130. As the pressure decreases, the bypass valve stem 154 displaces longitudinally back towards its rest position, thereby decreasing the flow through the secondary flow passageway 145. When the pressure decreases below the predetermined threshold value, the bypass valve stem 154 returns to its rest position (in contact with bypass valve seat 146), thereby substantially closing the secondary flow passageway.

Although the present invention and its advantages have been described in detail, it should be understood that various changes, substitutions and alternations can be made herein without departing from the spirit and scope of the invention as defined by the appended claims.

I claim:

1. A filter assembly comprising:

a housing having a through bore and a longitudinal axis, the through bore providing a primary flow passageway through the housing;

a bypass flow tube deployed in the through bore, the bypass flow tube providing a secondary flow passageway through the housing;

at least one primary filter deployed in the primary flow passageway;

a bypass filter disposed to filter fluid flow through the secondary flow passageway; and a bypass valve assembly deployed in the housing, the bypass valve assembly disposed to selectively open the secondary flow passageway when a fluid pressure reaches a predetermined threshold pressure.

2. The filter assembly of claim 1, wherein the bypass valve assembly is further disposed to selectively open and close the secondary flow passageway when the fluid pressure is respectively above and below the predetermined threshold pressure.

3. The filter assembly of claim 1, wherein the bypass how tube is substanlially coaxial with the housing.

4. The filter assembly of claim 1, wherein the housing comprises a drill collar having first and second threaded ends, the drill collar configured for coupling with a drill string.

5. The filter assembly of claim 1, wherein:

the bypass how tube comprises longitudinally opposed upstream and downstream ends, the upstream end located upstream at the at least one primary filter and the downstream end located downstream of the at least one primary filter; and the at least one primary filter is deployed about the bypass flow tube between an outer surface of the bypass flow tube and an inner surface of the housing.

6. The filter assembly of claim 1, further comprising a wear sleeve deployed in the housing, the primary flow passageway internal to an inner surface of the wear sleeve.

7. The filter assembly of claim 1, wherein the at least one primary filter comprises at least one filter screen.

8. The filter assembly of claim 1, comprising first and second primary filters deployed in the primary flow passageway.

9. The filter assembly of claim 8, wherein the first primary filter comprises a first filter screen and the second primary filter comprises a second filter screen, each of the first and second primary filter screens comprising a plurality of radial slots formed therein.

10. The filter assembly of claim 9, wherein:

the first filter screen is located upstream of the second filter screen; and a diameter of the radial slots formed in the first filter screen is greater than a diameter of the radial slots formed in the second filter screen.

11. The filter assembly of claim 9, wherein:

a diameter of the radial slots formed in the first filter screen is in a range from about ⅜ to about ⅝ inch; and a diameter of the radial slots formed in the second filter screen is in a range from about ¼ to about ½ inch.

12. The filter assembly of claim 1, wherein the at least one primary filter comprises a material having a Rockwell C hardness of greater than about 55.

13. The filter assembly of claim 1, wherein the bypass filter is coupled to an upstream end of the bypass flow tube.

14. The filter assembly of claim 1, wherein the bypass filter is located upstream of the at least one filter deployed in the primary flow passageway.

15. The filter assembly of claim 1, wherein:

the bypass filter is coupled to an upstream end of the bypass flow tube;

the bypass filter is located upstream of the at least one primary filter; and the bypass filter includes a plurality of clongated slots, a long axis of which is substantially parallel with the longitudinal axis of the housing.

16. The filter assembly of claim 1, wherein the predetermined threshold pressure is adjustable.

17. The filter assembly of claim 1, wherein the bypass valve assembly is deployed proximate to a downstream end of the bypass flow tube, the downstream end of the bypass flow tube located downstream of the at least one primary filter.

18. The filter assembly of claim 1, wherein the bypass valve assembly is biased in a closed position by a pressure setting spring.

19. The filter assembly of claim 18, wherein the pressure setting spring is rated in the range of from about 100 to about 400 pounds per compressed inch.

20. The filter assembly of claim 18, wherein:

the pressure setting spring is partially compressed when the bypass valve assembly is in the closed position; and the pressure setting spring is compressed to a greater extent when the bypass valve assembly is open.

21. The filter assembly of claim 18, wherein the bypass valve assembly includes a valve stem deployed in a bypass valve housing, the valve stem disposed to displace along the longitudinal axis between first and second positions, the valve stem biased towards the first position.

22. The filter assembly of claim 21, wherein:

the pressure setting spring is partially compressed when the valve stem is in the first position; and the pressure setting spring is substantially fully compressed when the valve stem is in the second position.

23. The filter assembly of claim 21, wherein a seating end of the valve stem is biased into scaling engagement with a valve seat on a downstream end of the bypass flow tube when the valve stem is in the first position.

24. The filter assembly of claim 21, wherein the fluid pressure urges the valve stein against its bias towards the second position when the fluid pressure reaches the predetermined pressure.

25. A filter assembly comprising:

a housing having a longitudinal axis;

a primary flow passageway through the housing, the primary flow passageway including at least one primary filter deployed therein;

a bypass second flow passageway including a bypass filter; and a bypass valve assembly deployed in the housing, the bypass valve assembly disposed to selectively open the bypass flow passageway when a fluid pressure reaches a predetermined threshold pressure.

26. The filter assembly of claim 25, wherein the bypass valve assembly is further disposed to selectively open and close the bypass flow passageway when the fluid pressure is respectively above and below the predetermined threshold pressure.

27. The filter assembly of claim 25, wherein:

the bypass filter is located upstream of the at least one primary filter; and the bypass filter comprises a plurality of elongated slots, a long axis of which is substantially parallel with the longitudinal axis of the housing.

28. The filter assembly of claim 25, wherein the bypass valve assembly is located downstream of the at least one primary filter.

29. A filter assembly comprising:

a substantially tubular housing having a longitudinal axis;

a bypass flow tube deployed substantially coaxially in the housing, the bypass flow tube having upstream and downstream ends;

a substantially annular primary flow passageway through the housing provided between an outer surface of the bypass flow tube and an inner surface of the housing;

a secondary flow passageway through the housing provided internal to an inner surface of the bypass flow tube;

at least one primary filter deployed in the primary flow passageway;

a bypass filter screen coupled to the upstream end of the bypass flow tube; and a bypass valve assembly deployed in the housing proximate to the downstream end of the bypass flow tube, the bypass valve assembly disposed to selectively open the secondary flow passageway when a fluid pressure reaches a predetermined threshold pressure.

30. The filter assembly of claim 29, wherein the bypass valve assembly is further disposed to selectively open and close the secondary flow passageway when the fluid pressure is respectively above and below the predetermined threshold pressure.

31. The filter assembly of claim 29, wherein:

the bypass filter is located upstream of the at least one primary filter; and the bypass filter comprises a plurality of elongated slots, a lung axis of which is substantially parallel with the longitudinal axis of the housing.

32. The filter assembly of claim 29, wherein:

a valve stem is biased into scaling engagement with a valve seat on the downstream end of the bypass flow tube when the bypass valve assembly is closed; and the fluid pressure urges the valve stem against its bias to open the bypass valve assembly when the fluid pressure is greater than the predetermined pressure.

33. A downhole filleting sub for filtering a drilling fluid, the filtering sub comprising:

a downhole tool body including a through bore and a longitudinal axis, the tool body further including first and second threaded ends, the tool body configured to be coupled to a drill string;

the through bore providing a primary flow passageway through the tool body in a direction substantially parallel with the longitudinal axis;

a bypass flow tube deployed in the through bore, the bypass flow tube providing a secondary flow passageway through the tool body;

at least one primary filter deployed in the primary flow passageway about the bypass flow tube;

a bypass filter coupled In the bypass flow tube, the bypass filter disposed to filter fluid flow through the secondary flow passageway; and a bypass valve assembly deployed in the housing, the bypass valve assembly disposed to selectively open the secondary flow passageway when a fluid pressure reaches a predetermined threshold pressure.

34. The filter assembly of claim 33, wherein the bypass valve assembly is further disposed to selectively open and close the secondary flow passageway when the fluid pressure is respectively above and below the predetermined threshold pressure.

35. The downhole filtering sub of claim 33, further comprising a wear sleeve deployed in the tool body, the primary flow passageway internal to an inner surface of the wear sleeve.

36. The downhole filtering sub of claim 33, wherein the bypass flow tube is substantially coaxial with the tool body.

37. The downhole filtering sub of claim 33, wherein the at least one primary filter comprises first and second filter screens, each of the first and second filter screens including a plurality of radial slots formed therein.

38. The downhole filtering sub of claim 37, wherein:

the first filter screen is located upstream of the second filter screen;

a diameter of the radial slots formed in the first filter screen is in a range from about ⅜ to about ⅝ inch; and a diameter of the radial slots formed in the second filter screen is in a range from about ¼ to about ½ inch.

39. The downhole filtering sub of claim 33, wherein:

the bypass filter is coupled to an upstream end of the bypass flow tube;

the bypass filter is located upstream of the at least one primary filter, and the bypass filter includes a plurality of elongated slots, a long axis of which is substantially parallel with the longitudinal axis of the tool body.

40. The downhole filtering sub of claim 33, wherein:

a valve stem is biased into sealing engagement with a valve seat on the downstream end of the bypass how tube when the bypass valve assembly is closed; and the fluid pressure urges the valve stem against its bias to open die bypass valve assembly when the fluid pressure reaches the predetermined pressure.

41. The downhole filtering sub of claim 40, wherein:

the valve stem is disposed to displace along the longitudinal axis between first and second positions, the valve stem being biased towards the first position by a pressure setting spring;

the pressure setting spring being partially compressed when the bypass valve assembly is closed; and the pressure setting spring being compressed to a greater extent when the bypass valve assembly is open.

42. A method for filtering a drilling fluid in a borehole, the method comprising:

(a) deploying a filtering sub in a borehole, the filtering sub coupled to a drill string, the filtering sub including:

a downhole tool body including a through bore and a longitudinal axis, the tool body further including first and second threaded ends, the tool body configured to be coupled to a drill string;

the through bore providing a primary flow passageway through the tool body in a direction substantially parallel with the longitudinal axis;

a bypass flow tube deployed in the through bore, the bypass flow tube providing a secondary flow passageway through the tool body;

at least one filter deployed in the primary flow passageway;

a bypass filter coupled to the bypass flow tube, the bypass filter disposed to filter fluid flow through the secondary flow passageway; and a bypass valve assembly deployed in the housing, the bypass valve assembly disposed to selectively open the secondary flow passageway when a fluid pressure reaches a predetermined threshold pressure; and (b) pumping drilling fluid through the drill string.

43. The method of claim 42, wherein:

the drill string comprises a drill bit deployed thereon; and the method further comprises (c) rotating the drill bit.

44. A method for fabricating a filter assembly, the filter assembly configured for filtering a drilling fluid, the method comprising:

(a) providing a drill collar, the drill collar having a through bore that provides a primary flow passageway through the drill collar, the drill collar configured for coupling with a drill string;

(b) deploying a bypass flow tube in the through bore, the bypass flow tube including longitudinally opposed first and second ends; the bypass flow tube providing a secondary flow passageway through the drill collar;

(c) deploying at least one filter in the primary flow passageway about the bypass flow tube;

(d) deploying a bypass filter to the first end of the bypass flow tube, the bypass filter disposed to filter fluid flow through the secondary flow passageway;

(e) deploying a bypass valve assembly in the drill collar proximate the second end of the bypass flow tube, the bypass valve assembly disposed to selectively open the secondary flow passageway when a fluid pressure reaches a predetermined threshold pressure.

* * * * *